US005601443A

United States Patent [19]

Stinsky et al.

[11] Patent Number: 5,601,443

[45] Date of Patent: Feb. 11, 1997

[54] AUTO SEIZING CONNECTOR

[75] Inventors: Vadim Stinsky, Ithaca; Thomas G. Macek, Endicott, both of N.Y.

[73] Assignee: Augat Inc., Mansfield, Mass.

[21] Appl. No.: 547,866

[22] Filed: Oct. 25, 1995

[51] Int. Cl.[6] ..... H01R 13/15

[52] U.S. Cl. ..... 439/263; 439/848

[58] Field of Search ..... 439/263, 346, 439/578, 583, 584, 848

[56] References Cited

U.S. PATENT DOCUMENTS

| | | | |
|---|---|---|---|
| 3,673,547 | 6/1972 | Ziegler, Jr. | 439/320 X |
| 3,706,958 | 12/1972 | Blanchenot . | |
| 3,744,011 | 7/1973 | Blanchenot . | |
| 4,648,684 | 3/1987 | Mattis et al. . | |
| 4,676,577 | 6/1987 | Szegda | 439/584 |
| 4,696,532 | 9/1987 | Mattis | 439/863 |
| 4,854,893 | 8/1989 | Morris | 439/578 |
| 4,897,045 | 1/1990 | Dyck | 439/578 |
| 4,923,412 | 5/1990 | Morris | 439/578 |
| 5,002,503 | 3/1991 | Campbell et al. | 439/578 |
| 5,096,444 | 3/1992 | Lu et al. | 439/750 |
| 5,342,218 | 8/1994 | McMills et al. | 439/578 |
| 5,352,134 | 10/1994 | Jacobsen et al. | 439/584 |

*Primary Examiner*—Khiem Nguyen

*Attorney, Agent, or Firm*—Weingarten, Schurgin, Gagnebin & Hayes LLP

[57] ABSTRACT

An auto seizing connector is provided having complimentary male and female portions. The female portion includes a movable closing collar having a converging passage that surrounds a first terminal associated with the female portion. A fitting retained within a cavity of the female portion proximate the closing collar is pressed against the closing collar as the distal end of the male portion is inserted into the cavity, causing the closing collar to move with respect to the first terminal, thereby causing the first terminal to seize or securely engage a second terminal associated with the male portion when the connector portions are fully mated.

12 Claims, 3 Drawing Sheets

AUTO SEIZING CONNECTOR

FIELD OF THE INVENTION

The invention relates to electrical connectors, and more specifically to an auto seizing connector.

BACKGROUND OF THE INVENTION

Auto seizing connectors are used to make secure electrical connections in a minimal number of connection steps. With respect to coaxial cables, for example, one cable end can be fitted with a male portion of an auto seizing connector and another cable end can be provided with a complimentary female portion. As the male and female portions are pressed or screwed together to fully mate them, a female contact or terminal within the female portion grips and locks on to a male contact or pin terminal associated with the male portion.

FIG. 1 illustrates an exemplary prior art fully mated auto seizing connector, wherein the distal end 12 of a male portion 14 abuts a wall 16 that defines one end of a cavity 18 within a female portion 20. Prior to completing the connection or being fully mated, a closing collar 22, having a converging passage 24 therethrough for receiving a female terminal 26, is movable within an aperture 28 in the wall 16 of the female portion 20 so that a cavity facing end or portion 30 of the closing collar 22 can extend into the cavity 18. During connection of the male and female portions 14, 20, the distal end 12 of the male portion 14 abuts the cavity facing portion 30 of the closing collar 22 and pushes the closing collar out of the cavity 18. As the closing collar 22 moves axially, the inner wall of the closing collar which defines the converging passage 24 presses against the tapered outer surface of the female terminal 26 and causes a passage 32 within the female terminal 26 to compress radially from a first engagement state to a second engagement state. The diameter of the passage 32 in the second engagement state is sufficiently reduced to seize a male terminal 34 which is associated with the male portion 14 and which is inserted into the passage as the male portion approaches the closing collar 22. When the male and female portions 14, 20 are mated, the distal end 12 of the male portion 14 inhibits or blocks axial movement of a closing collar 22 beyond the wall 16 and back into the cavity 18, thus ensuring a solid electrical connection until the connector portions are separated.

The Society of Cable and Television Engineers (SCTE) has promulgated new standards relating to connectors for cable television applications (CATV). More specifically, SCTE standards IPS-SP-500 and IPS-SP-501 (hereinafter "the standards") set forth dimensional requirements for both the male and female connector portions. However, when the standards are applied to auto seizing connectors, problems arise.

Problems related to the new standards are illustrated in FIG. 2, wherein a male portion 42 in accordance with the standards is shown fully mated with a female portion 20 in accordance with the standards. Under the new standards, although the male portion has substantially the same dimensions as the "pre-standard" male portion, the new female portion 20 has a deeper or longer cavity 18 than that of the "pre-standard" female connector. Therefore, the distal end of the male portion 42 is unable to either abut the closing collar 22 or push it completely through the wall 16. Accordingly, the closing collar 22 is unable to compress the female terminal 26 about the male terminal 34. Thus, the combination of either an old male portion or a male portion 42 in accordance with the standards, and a new female portion 20 is inoperable. A device is needed that not only allows old connector portions to function with new connector portions, but also allows connectors having both portions manufactured in accordance with the new standards to function properly.

SUMMARY OF INVENTION

The present invention corrects deficiencies of auto seizing connectors that comply with SCTE standards. In an exemplary embodiment of the invention, an auto seizing connector includes a first connector portion defining a first aperture for receiving a closing collar movably disposed within the first aperture. The closing collar defines a second aperture for receiving a first electrical terminal. Relative movement of the closing collar with respect to the first electrical terminal from a first position to a second position causes the terminal to transition from a first engagement state to a second engagement state. A second connector portion supports a second electrical terminal engageable with the first electrical terminal. An extension fitting is positioned between the first connector portion the and the second connector portion. The extension fitting increases the effective length of the second connector portion to allow the closing collar to be pushed over the first electrical terminal by the second connector portion.

In an exemplary embodiment, the extension fitting is annular. In another embodiment, the extension fitting is provided with a boss on at least a portion of the fitting to enable it to be more securely retained within the first connector portion.

BRIEF DESCRIPTION OF DRAWINGS

A more complete understanding of the present invention and the attendant advantages and features thereof will be more readily understood by reference to the following detailed description when considered in conjunction with the accompanying drawings wherein.

DETAILED DESCRIPTION OF THE INVENTION

Figure 3:
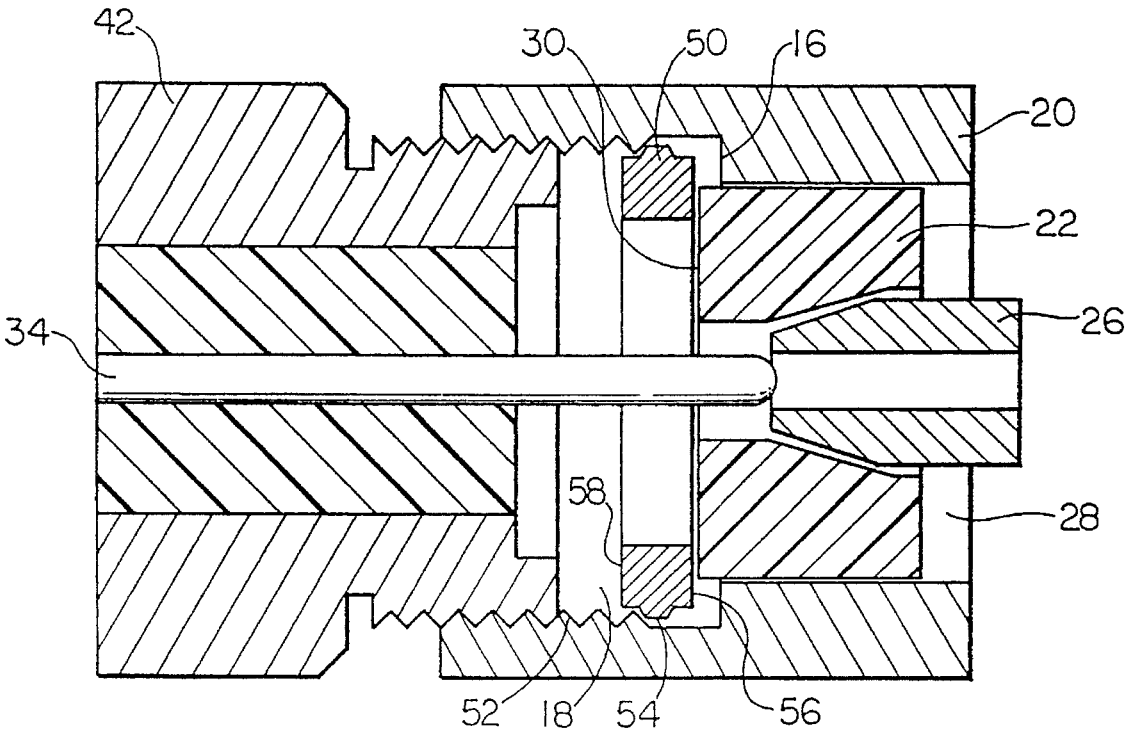
FIG. 3 is a cross-sectional view of a partially mated auto seizing connector having male and female portions that comply with the SCTE standards, and an extension fitting in accordance with the invention.

FIG. 3 illustrates a partially mated auto seizing connector having male and female portion 20 and 42, respectively, that comply with the SCTE standards. An extension fitting 50 is loosely retained within the cavity 18 so that it can "float" between threads 52 and the wall 16. A protuberance or boss 54 can be provided on the outer surface of the extension fitting 50 to retain the extension fitting within the cavity 18 until the connector is fully mated. Even when the extension fitting 50 is retained within the cavity 18, the cavity facing end 30 of the closing collar 22 is able to move beyond the wall 16 and into the cavity 18 until the connector is fully mated.

The extension fitting 50 has a substantially annular shape so that the male pin terminal 34 is able to pass through the extension fitting 50 and into the female terminal 26. The extension fitting 50 has an outer diameter greater than the diameter of the aperture 28 through which the closing collar 22 is received within the female portion 20. The extension fitting 50 has an inner diameter that is less than the diameter of the aperture 28. Thus, the extension fitting 50 has a wall thickness great enough so that a first end 56 is able to simultaneously abut the wall 16 of the female portion 20 and the cavity facing end 30 of the closing collar 22. The extension fitting 50 has a second end 58 that provides an abutment surface for the distal end 12 of the old male portion 42. In an exemplary embodiment, the extension fitting is a metal ring measuring 0.08 inches from end to end.

Figure 1:
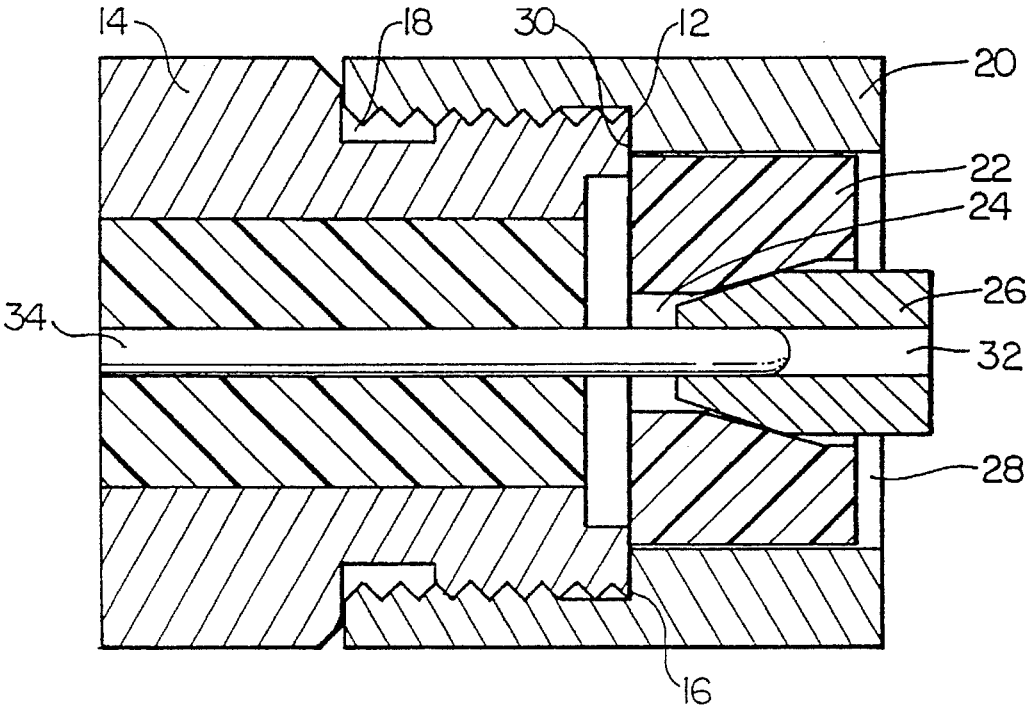
FIG. 1 (PRIOR ART)
FIG. 1 is a cross-sectional view of a fully mated exemplary prior art auto seizing connector having male and female portions.
Figure 2:
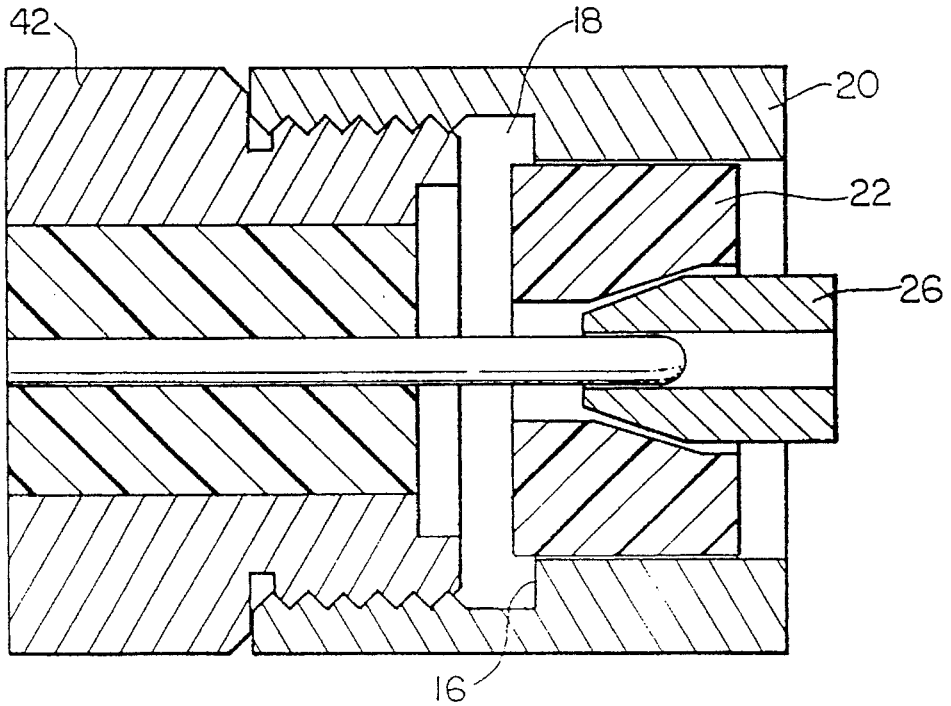
FIG. 2 (PRIOR ART)
FIG. 2 is a cross-sectional view of a fully mated prior art auto seizing connector having male and female portions that comply with the SCTE standards.
Figure 4:
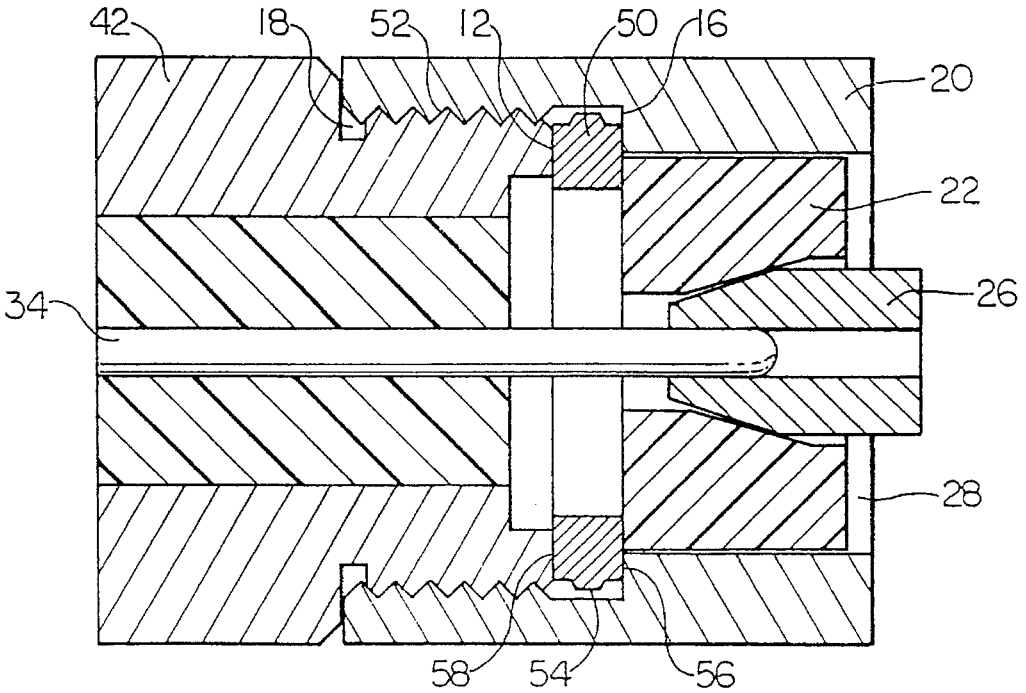
FIG. 4 is a cross-sectional view of a fully mated auto seizing connector having male and female portions that comply with the SCTE standards, and an extension fitting in accordance with the invention.

When the distal end 12 of the male portion 42 is threaded into the female portion 20, the distal end 12 of the male portion eventually abuts the second end 58 of the extension fitting 50. As the male portion 42 continues to be tightened, the first end of the extension fitting 50 is pressed against the closing collar 22 and the male pin terminal 34 enters the female terminal 26. Continued tightening of the male portion 42 causes the closing collar 22 to move with respect to the female terminal 26, thereby causing the female terminal to transition from a first engagement position to a second engagement position and seize the male terminal 34, as described above with respect to FIG. 1. FIG. 4 illustrates the connector in a fully mated state.

Figure 5:
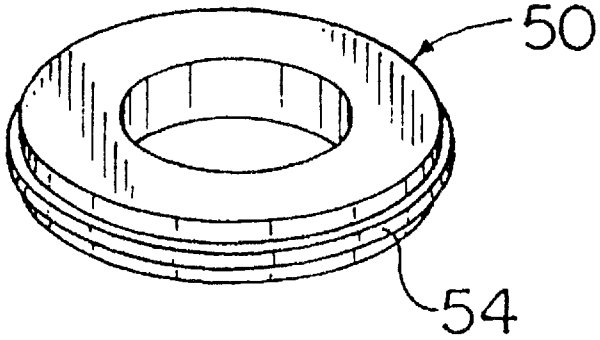
FIG. 5 is a perspective view of the extension fitting of FIGS. 3 and 4.

FIG. 5 is a perspective view of only the extension fitting 50. In the illustrated embodiment, the boss 54 is shown as a continuous annular band. However, the boss can also be discontinuous or notched.

A variety of modifications and variations of the present invention are possible in light of the above teachings. It is therefore to be understood that, within the scope of the appended claims, the present invention may be practiced otherwise than as specifically described hereinabove.

What is claimed is:

1. An auto seizing connector comprising:

a first connector portion defining a first aperture for receiving a closing collar;

a closing collar movably disposed within said first aperture, said closing collar defining a second aperture for receiving a first electrical terminal, wherein relative movement of said closing collar with respect to said first electrical terminal causes said terminal to move from a first engagement position to a second engagement position;

a second connector portion for supporting a second electrical terminal, wherein said second electrical terminal is engageable with said first electrical terminal; and an extension fitting positioned between said first connector portion and said second connector portion, said extension fitting having a first end for abutting said second connector portion and a second end for abutting said closing collar, said extension fitting including a boss on at least a portion thereof.

2. The auto seizing connector of claim 1, wherein said extension fitting is annular.

3. The auto seizing connector of claim 2, wherein said extension fitting has an outer diameter greater than said first aperture and an inner diameter less then said first aperture.

4. The auto seizing connector of claim 1, wherein said extension fitting is retained within said first connector portion in the absence of said second connector portion.

5. The auto seizing connector of claim 1, wherein said boss increases the outer diameter of said extension fitting.

6. The auto seizing connector of claim 5, wherein said extension fitting is approximately 0.08 inches long.

7. An auto seizing connector comprising:

a female connector portion defining a first annular passage and a second annular passage, wherein a portion of said first annular passage includes a plurality of female threads disposed thereon;

an annular closing collar movably disposed within said second passage, said closing collar defining an annular channel having a first opening of greater diameter than a second opening;

a female terminal defining a passage therethrough, said female terminal disposed within said channel of said closing collar;

a male connector portion having a distal end and defining a plurality of male threads on an outer portion thereof, said plurality of male threads engageable with said female threads of said female connector portion;

a male terminal protruding from said male connector portion distal end adapted for insertion within said female terminal; and an extension fitting adapted for insertion between said male and female connector portions, said extension fitting having a first end for abutting said distal end of said male connector portion and a second end for abutting an end of said closing collar.

8. The auto seizing connector according to claim 7, wherein said auto seizing connector conforms to the Society of Cable and Television Engineers (SCTE) standards IPS-SP-500 and IPS-SP-501.

9. The auto seizing connector according to claim 7, wherein said extension fitting includes a boss adapted for retaining said extension fitting within said female connector portion.

10. The auto seizing connector according to claim 7, wherein said female connector portion further includes a shoulder at the intersection of said first and second passages.

11. The auto seizing connector according to claim 10, wherein said boss of movably retains said extension fitting between said shoulder and said plurality of female threads of said female connector portion.

12. The auto seizing connector according to claim 7, wherein said extension fitting second end, said end of said closing collar and said shoulder substantially form a plane upon engagement of said male and female connector portions.

* * * * *